US010986911B2

(12) United States Patent
Cotirla et al.

(10) Patent No.: US 10,986,911 B2
(45) Date of Patent: Apr. 27, 2021

(54) BACKPACK CARRIER

(71) Applicant: Blue Box Toy Factory Limited, Kowloon (HK)

(72) Inventors: Adrian Cristian Cotirla, Oak Park, IL (US); Leslie A. Roeder, New York, NY (US); John (Jason) C. Arnold, IV, Encinitas, CA (US)

(73) Assignee: BLUE BOX TOY FACTORY LIMITED, Hong Kong (HK)

( * ) Notice: Subject to any disclaimer, the term of this patent is extended or adjusted under 35 U.S.C. 154(b) by 27 days.

(21) Appl. No.: 16/560,831

(22) Filed: Sep. 4, 2019

(65) Prior Publication Data

US 2020/0085175 A1 Mar. 19, 2020

Related U.S. Application Data

(60) Provisional application No. 62/732,969, filed on Sep. 18, 2018.

(51) Int. Cl.
*A45F 4/02* (2006.01)
*A47D 13/02* (2006.01)

(52) U.S. Cl.
CPC ..... *A45F 4/02* (2013.01); *A47D 13/025* (2013.01)

(58) Field of Classification Search
CPC ..... A45F 4/02; A45F 2003/045; A45F 3/047; A45F 2003/144; A47D 13/025; A45C 2003/005
See application file for complete search history.

(56) References Cited

U.S. PATENT DOCUMENTS

| | | | | |
|---|---|---|---|---|
| 4,333,591 | A | 6/1982 | Case | |
| 5,025,965 | A | 6/1991 | Smith | |
| 5,292,042 | A | 3/1994 | Yamaguchi et al. | |
| 5,649,658 | A | 7/1997 | Hoffman et al. | |
| 5,711,466 | A | 1/1998 | Kataoka et al. | |
| 5,799,851 | A * | 9/1998 | Wulf | A45C 7/0045 224/580 |
| 5,934,528 | A | 8/1999 | Higuchi | |
| 6,325,259 | B1 | 12/2001 | Tharalson et al. | |
| 6,619,519 | B1 | 9/2003 | Nix et al. | |
| 6,655,565 | B2 | 12/2003 | Godshaw et al. | |
| 6,866,173 | B2 | 3/2005 | Haber | |
| 7,484,645 | B2 | 2/2009 | Hoff et al. | |
| 7,614,533 | B2 | 11/2009 | Boal et al. | |
| 7,942,296 | B1 | 5/2011 | Johnson | |
| 8,001,803 | B2 | 8/2011 | Kanagaki | |
| 8,490,230 | B2 | 7/2013 | Rovin | |
| 8,998,051 | B2 | 4/2015 | Demskey | |
| 9,295,341 | B2 | 3/2016 | Sonnenberg | |
| 9,439,515 | B2 | 9/2016 | Kim | |
| 9,480,344 | B1 * | 11/2016 | Vialpando | B60N 2/26 |
| 9,801,451 | B2 | 10/2017 | Murdoch et al. | |
| 9,820,558 | B1 * | 11/2017 | de Geus | A45F 4/02 |

(Continued)

*Primary Examiner* — Brian D Nash
(74) *Attorney, Agent, or Firm* — Stetina Brunda Garred and Brucker; Mark B. Garred

(57) ABSTRACT

A dual-purpose backpack carrier comprising a backpack like structure which may be used alone, or in conjunction with a selectively deployable soft infant carrier which is outfitted with a flap arrangement adapted to allow for adjustability to the effective width of the seat portion of the carrier so as to accommodate children of differing size.

18 Claims, 7 Drawing Sheets

(56) References Cited

U.S. PATENT DOCUMENTS

| | | | | |
|---|---|---|---|---|
| 2002/0113103 | A1* | 8/2002 | O'Hare | A45F 3/08 224/155 |
| 2005/0194413 | A1* | 9/2005 | Baker | A45F 4/02 224/153 |
| 2007/0228091 | A1 | 10/2007 | Shawen | |
| 2009/0272773 | A1* | 11/2009 | Andrade | A47D 13/025 224/153 |
| 2009/0321481 | A1 | 12/2009 | Licausi | |
| 2012/0152991 | A1* | 6/2012 | Roane | A45C 7/0086 224/259 |
| 2014/0131401 | A1* | 5/2014 | Workman | A47D 13/025 224/160 |
| 2016/0286939 | A1* | 10/2016 | Spears | A45F 3/04 |
| 2017/0150826 | A1* | 6/2017 | Salazar | A47D 13/025 |
| 2017/0318941 | A1* | 11/2017 | Vaughan | F41H 1/02 |
| 2018/0008024 | A1 | 1/2018 | Barton | |
| 2018/0035823 | A1* | 2/2018 | Landeros | A45F 3/04 |
| 2018/0184813 | A1* | 7/2018 | Salazar | A47D 13/025 |
| 2019/0075937 | A1* | 3/2019 | Salazar | A47D 13/025 |

* cited by examiner

BACKPACK CARRIER

CROSS-REFERENCE TO RELATED APPLICATIONS

The present application claims priority to U.S. Provisional Patent Application Ser. No. 62/732,969 entitled Backpack Carrier filed Sep. 18, 2018, the disclosure of which is incorporated herein by reference.

STATEMENT RE: FEDERALLY SPONSORED RESEARCH/DEVELOPMENT

Not Applicable

BACKGROUND

1. Technical Field

The present disclosure generally relates to infant related items such as diaper bags and infant carriers, and more particularly to a dual-purpose backpack carrier comprising a backpack like structure which may be used alone, or in conjunction with a selectively deployable soft infant carrier which is outfitted with a flap arrangement adapted to allow for adjustability to the effective width of the seat portion of the carrier.

2. Description of the Related Art

It is common practice for parents and other caregivers to carry infants and toddlers, and there is a variety of well-known infant carrier products in the prior art which are configured to be worn by an adult for on-the-body carrying of the infant or toddler. These products include slings, wraps, pouches, and backpack-like devices outfitted with shoulder strap devices in varying configurations and arrangements. Shoulder-supported infant carriers are particularly growing in popularity for supporting or transporting an infant or young child. A common attribute of these carriers is that they typically offer "hands free" operation and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in places such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant and are typically used to carry the infant of the front or chest of the wearer.

Although soft-sided carriers have become a popular means for transporting an infant, even with the various comfort and "hands-free" operational advantages provided by such soft-sided carriers, they still suffer from one or more drawbacks. One such drawback relates to the very limited availability, if any, of storage space within the carrier for various items and articles needed for infant care when traveling or on the go with the infant in the carrier. This lack of storage space often necessitates that the parent or caregiver still use one of his or her free hands to carry a diaper bag or similar storage article. Another common drawback associated with conventional soft-sided carriers is that the seat portion of the carrier is of a fixed size. Therefore, as the infant grows, the seat portion of the carrier may become too small, or when the infant is young, the seat portion of the carrier may be configured to support a larger infant, and thus, may be too big.

The combination backpack and infant carrier described below addresses these drawbacks by providing a backpack like structure which has a high storage capacity and may be used alone, or in conjunction with a selectively deployable soft infant carrier. The carrier itself includes a selectively deployable flap arrangement adapted to allow for adjustability to the effective width of the seat portion of the carrier in a quick and easy manner. These and other aspects of the present backpack carrier will be discussed in more detail below.

BRIEF SUMMARY

Various aspects of the present disclosure are directed to a backpack carrier comprising a backpack like structure or component which may be used alone, or in conjunction with a selectively deployable soft infant carrier component. As such, the backpack carrier of the present disclosure is a multi-purpose article, capable of being used solely as a backpack, or selectively as a combination backpack and infant carrying device. The backpack component is outfitted with several internal or interior compartments capable of storing various articles, some of which may be related to the care of an infant. In this regard, when used predominantly for child care while traveling, the backpack component essentially serves as a very large, robust diaper bag, capable of storing a wide array of infant care items. The backpack component is also outfitted with a detachable and deployable changing mat.

The soft infant carrier component is hidden inside the bottom of the backpack component in a zippered compartment or pocket. The wearer can unzip the pocket and pull out the carrier component. The carrier component is permanently attached to a waist or lumbar belt secured to the backpack component and hooks up to various attachment points of the backpack component (notably its straps) for use in accommodating a child.

In greater detail, the bottom of a carrier body/panel of the carrier component is permanently secured to a lumbar belt front thereof by, for example, stitching. The carrier body and lumbar belt front are stored in a carrier storage compartment which is defined by and is a false bottom to the backpack carrier component. The lumbar belt front is outfitted with a pair of toggles, which may be advanced through respective openings or slits in a pair of flaps of the carrier body to maintain the flaps in an extended or deployed state. The flaps are also each outfitted with a snap as allows them to be secured to each other in a folded stated via those snaps, as opposed to being attached to complementary snaps on the outer surface of the carrier body when folded.

In addition, a lumber belt back of the backpack component, which is permanently attached thereto, is stored within the carrier storage pocket/compartment used to accommodate the stored carrier component comprising the carrier body and lumbar belt front. With the pocket being opened and the lumbar belt back being removed from within the pocket, along with the removal of the carrier body/lumbar belt front from storage, a strap extending from the lumbar belt front may be advanced through a corresponding sleeve of the lumbar belt back to operatively connect them to each other. Thereafter, a series of fasteners is used to facilitate the releasable attachment of the carrier body to corresponding regions of the backpack component shoulder straps as forms an infant carrying pouch.

The selectively deployable flap arrangement of the carrier body is adapted to allow for the adjustability to the effective width of the seat portion of the carrier component so as to accommodate children of differing size, as well as different support positions/configurations. In this regard, the carrier body defines a seat portion, a head portion, a central portion between the seat and head portions, with the pair of generally triangular conversion flaps protruding from the seat portion in opposed relation to each other. As indicated above, the lower end of carrier body is attached to the lumber belt front, with the conversion flaps being selectively transitional between a stowed or narrow configuration, wherein free end portions of the conversion flaps are releasably attached to each other, and a deployed or wide configuration wherein the free end portions of the conversion flaps are releasably attached to the lumbar belt front.

Each of the conversion flaps includes an elongate slot and an adjacent fastener (e.g., a conversion snap) disposed at the free end portion thereof. As also indicated above, each slot is adapted to accommodate a respective one of a pair of toggles attached to the lumbar belt front at or proximate to the top edge thereof. The receipt of the toggles into corresponding ones of the slots effectively maintains the conversion flaps in the wide configuration. Conversely, the removal of the toggles from within the slots allows the conversion flaps to be folded inwardly toward each other in overlapping relation to the central portion of the main body panel. In this folded state, the conversion snaps (one male, one female) of the conversion flaps may be releasably attached to each other as effectively maintains the conversion flaps in the narrow configuration.

The lumbar belt front of the carrier component further comprises a pair of leg loops which are attached thereto proximate to the top edge thereof. The leg loops are selectively, releasably attachable to respective ones of a corresponding pair of fasteners (e.g., buttons) disposed on the outer surface of the carrier body. The leg loops, when attached to the buttons, create prescribed attachment points between corresponding side edges of the carrier body and the waist or lumbar belt of the backpack carrier collectively defined by the lumbar belt front and back, in addition to a strap, as facilitates the formation of a spaced pair of comparatively smaller leg openings between the leg loops and the lumbar/waist belt.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
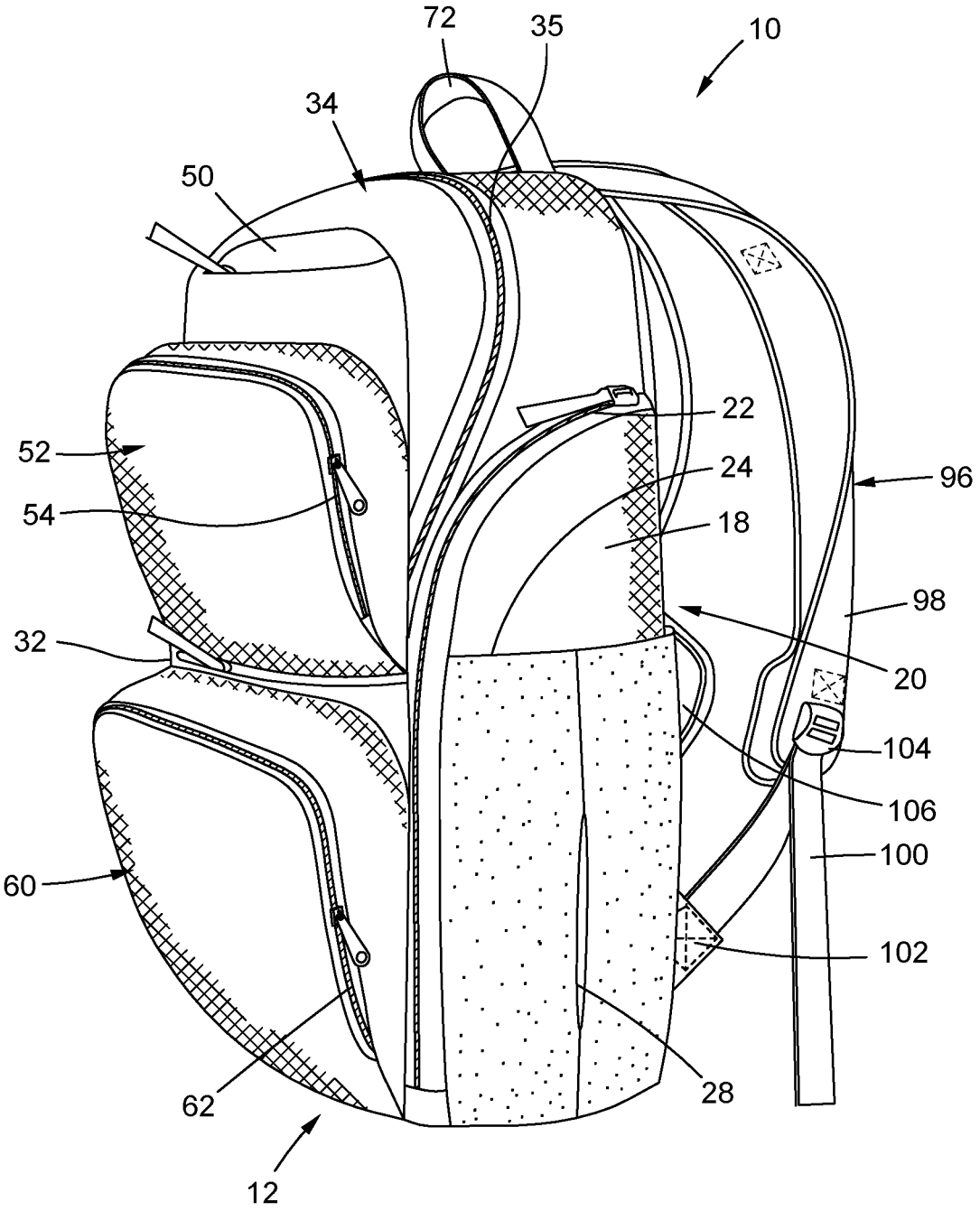
FIG. 1 is a rear perspective view of the backpack carrier constructed in accordance with the present disclosure, depicting the backpack component as having the soft infant carrier component stored therein and not deployed therefrom.

Referring now to the drawings, wherein the showings are for purposes of illustrating one embodiment of the present disclosure only, and not for purposes of limiting the same, there is depicted a dual-purpose backpack carrier 10 constructed in accordance with the present disclosure. As will be described in more detail below, the backpack carrier 10 comprises a backpack component 12 which has a high storage capacity, and may be used alone, or in conjunction with a selectively deployable soft infant carrier component 14. The carrier component 14 is outfitted with a flap arrangement adapted to allow for adjustability to the effective width of a seat portion denied thereby, as will also be discussed in more detail below. By allowing for adjustability to the effective width of its seat portion, the carrier component 14 can be used to accommodate children of differing size.

Figure 2:
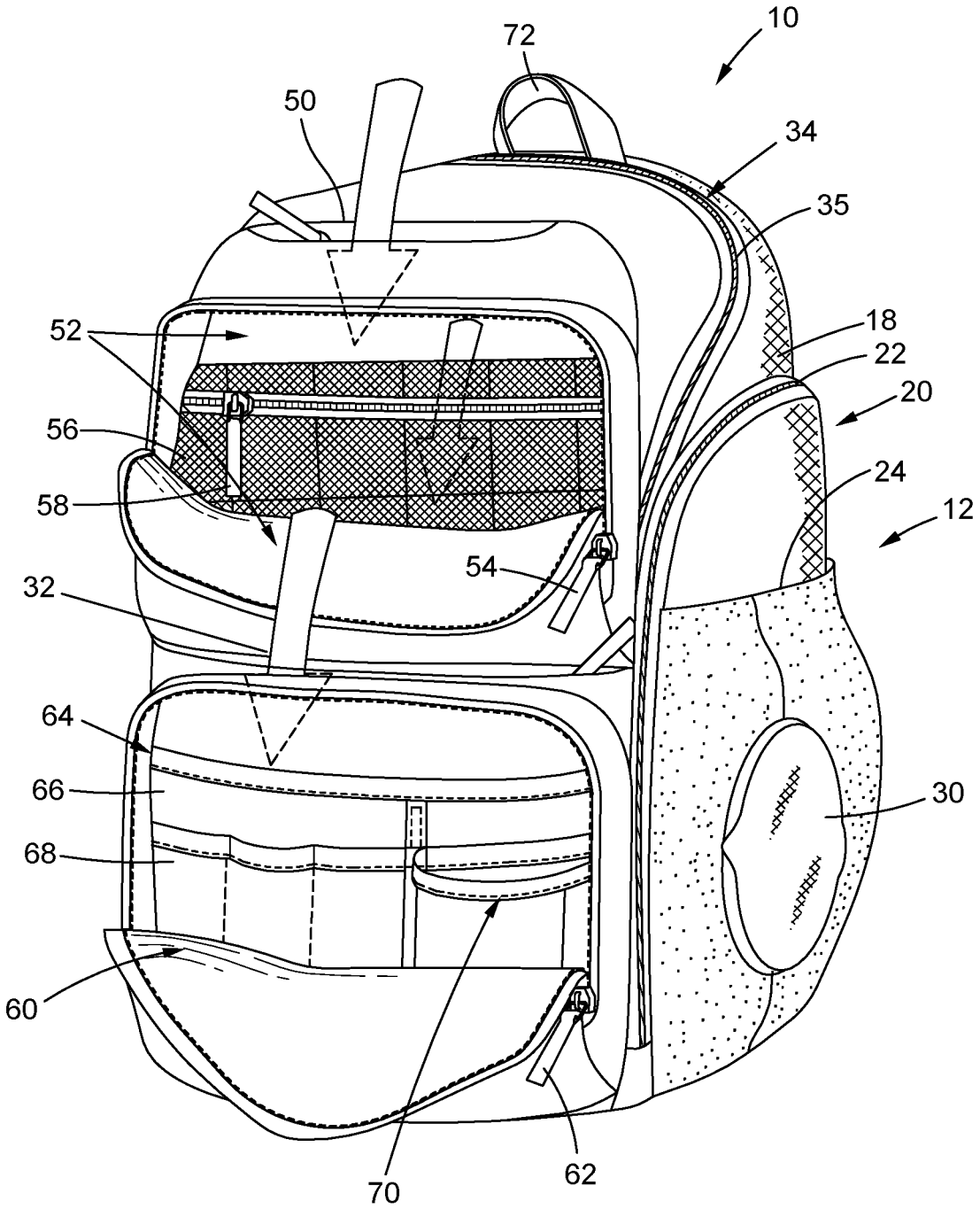
FIG. 2 a rear perspective view of the backpack component of the backpack carrier, depicting several internal storage areas defined by the backpack component.

Referring now to the FIGS. 1-5, the backpack component 12 has the general shape/profile of a conventional backpack. In greater detail, the backpack component 12 includes an exposed front panel 16 which, when the backpack carrier 10 is worn in its intended manner, will be in direct contact with the wearer's back. A series of side panels 18 extend about the periphery of the front panel 16 in a pattern and arrangement as facilitates the formation of multiple side pockets and pouches. In the exemplary backpack component 12 shown in FIGS. 1-3, these include a pair of large, zippered side storage pouches 20 extending vertically along respective opposed sides of the backpack component 12. Each of these side storage pouches 20 is selectively openable (i.e., accessible) and closable using a corresponding zipper 22. The side panels 18, in addition to facilitating the formation of the side storage pouches 20, further facilitate the formation of an opposed pair of storage pockets 24 which are partially defined by respective ones of the side storage pouches 20. When viewed from the perspective shown in FIGS. 1-3, the interior of each of the storage pockets 24 is accessible proximate the top edge thereof, with the storage pockets 24 being suited for storing items such as the exemplary baby bottle 26 shown in FIGS. 3 and 6. It is also contemplated that in accordance with an exemplary embodiment of the backpack component 12, one of the side panels 18 used to facilitate the formation of a corresponding one of the storage pockets 24 may include an elongate slit 28 formed therein as makes such corresponding storage pocket 24 particularly suited for accommodating a packet of baby wipes 30 as depicted in FIG. 2.

In addition to the front and side panels 16, 18, the backpack component 12 includes a series of back panels 32 which are joined to the side panels 18 in a pattern and arrangement as facilitates the formation of multiple back pockets and pouches. As will be recognized by those familiar with conventional backpack design and construction techniques, at least certain ones of the pockets or pouches of the backpack component 12 as described above and as will be described below may be defined by one or more of the front, side and back panels 16, 18, 32 in any combination with each and/or one or more interior panels of the backpack component 12, some of which may not be depicted or described with particularity below.

Figure 3:
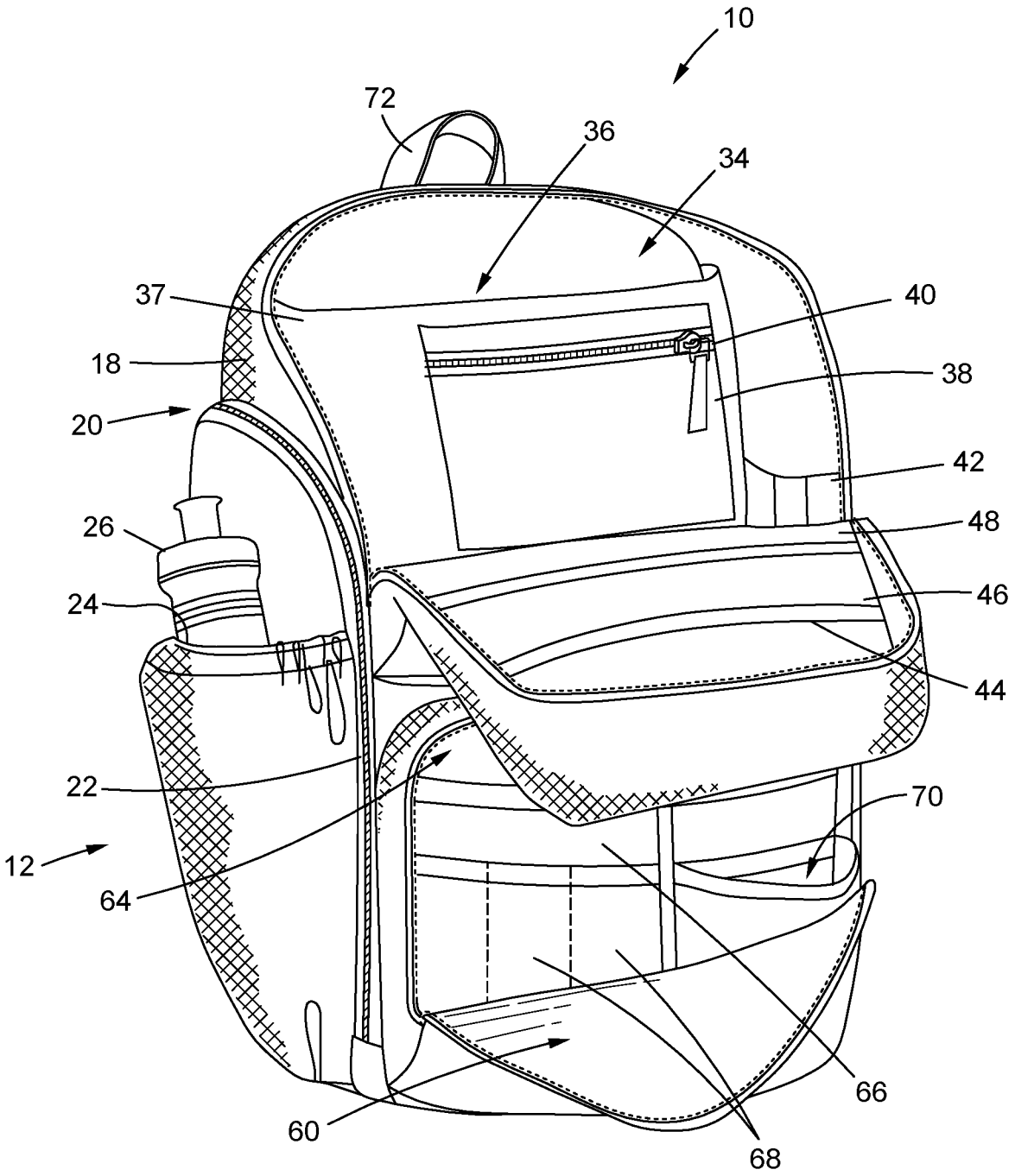
FIG. 3 is a rear perspective view of the backpack component of the backpack carrier similar to FIG. 2, depicting several additional internal storage areas defined by the backpack component.

In the exemplary backpack component 12 shown in FIGS. 1-3, the aforementioned back pockets and pouches include a large, zippered top storage pouch 34 extending along approximately the upper half of the backpack component 12. In FIGS. 1-2, the top storage pouch 34 is shown as being closed using a corresponding zipper 35 as the closure mechanism. In FIG. 3, the top storage pouch 34 is shown as being open, with one of the back panels 32 which partially defines the top storage pouch 34 being folded outwardly as depicts several other storage areas residing within the interior thereof in accordance with an exemplary implementation of the backpack component 12.

In greater detail, it is contemplated that residing within the interior of the top storage pouch 34 is a laptop pocket 36. The interior panel 37 of the backpack component 12 partially defining the laptop pocket 36 in turn includes a small electronics pocket or pouch 38 on the outer surface thereof. This small electronics pouch 38 is selectively openable and closable within the interior of the top storage pouch 34 using a corresponding interior zipper 40. Adjacent the small electronics pouch 38 within the interior of the top storage pouch 34 is a mesh side pocket 42.

That back panel 32 which partially defines the top storage pouch 34 and is shown in FIG. 3 as being folded outwardly has several additional interior panels of the backpack component 12 attached to the interior surface 44 thereof. These additional interior panels partially define an upper open pocket 46 and a lower open pocket 48 which is immediately below the upper open pocket 46.

At least one additional back panel 32 is secured to the exterior surface of that partially defining the top storage pouch 34 as facilitates the formation of a top pocket 50. In a similar fashion, one or more additional back panels 32 are secured to the exterior surface of that used to partially define the top pocket 50 as facilities the formation of a top exterior storage pouch 52. In FIG. 1, the top exterior storage pouch 52 is shown as being closed using a corresponding zipper 54 as the closure mechanism. In FIG. 2, the top exterior storage pouch 52 is shown as being open, with one of the back panels 32 which partially defines the top exterior storage pouch 52 being folded outwardly as depicts another storage area residing within the interior thereof in accordance with an exemplary implementation of the backpack component 12. In greater detail, this additional storage area residing within the interior of the top exterior storage pouch 52 is a mesh pocket 56 which is selectively openable and closable using a corresponding zipper 58.

Also included in the multiple pockets and pouches at least partially defined by the series of back panels 32 of the exemplary backpack component 12 is a large, zippered bottom exterior storage pouch 60 which extends along approximately the lower half of the backpack component 12. In FIG. 1, the bottom exterior storage pouch 60 is shown as being closed using a corresponding zipper 62 as the closure mechanism. In contrast, in FIGS. 2-3, the bottom exterior storage pouch 60 is shown as being open, with one of the back panels 32 which partially defines the bottom exterior storage pouch 60 being folded outwardly as depicts several other storage areas residing within the interior thereof in accordance with an exemplary implementation of the backpack component 12.

In greater detail, it is contemplated that residing within the interior of the bottom exterior storage pouch 60 is a pocket 64. The interior panel 66 of the backpack component 12 partially defining the pocket 64 in turn includes a series of three (3) small sleeve pockets 68 on the outer surface thereof. Adjacent the small sleeve pockets 68 within the interior of the bottom exterior storage pouch 60 is an insulated bottle pocket 70.

Figure 4:
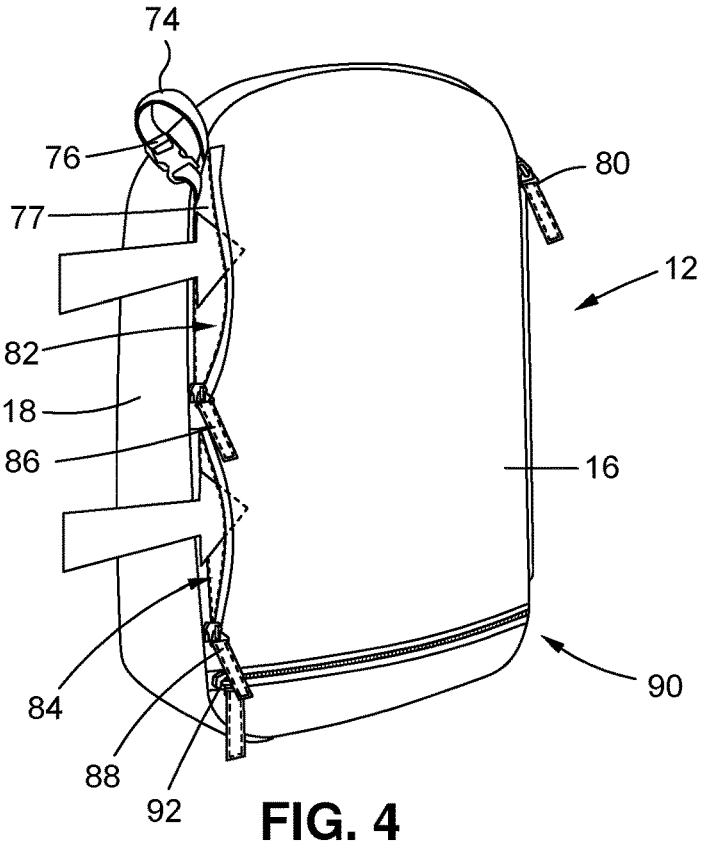
FIG. 4 a front perspective view of the backpack component of the backpack carrier, depicting several additional internal storage areas defined by the backpack component.
Figure 5:
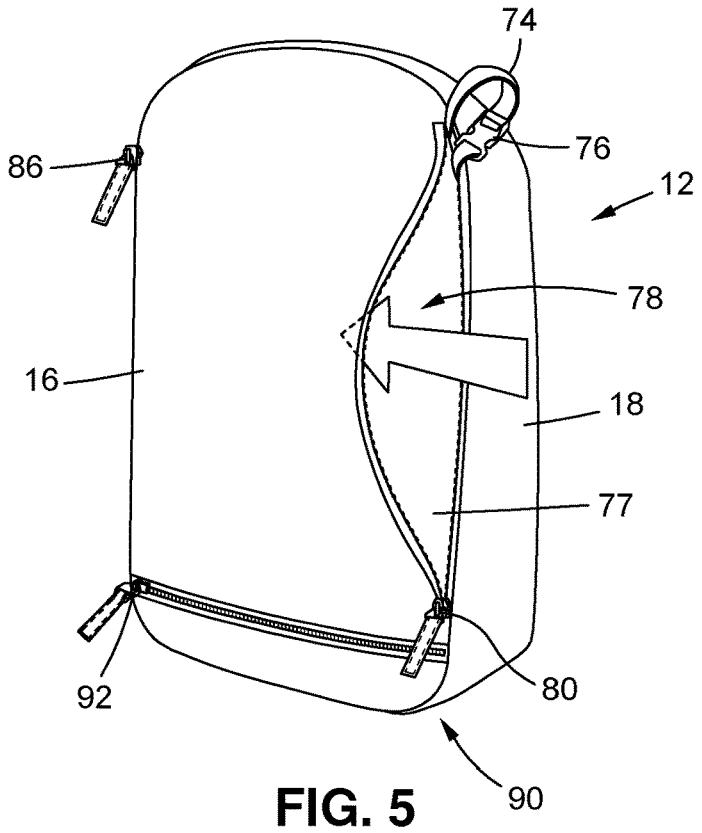
FIG. 5 is a front perspective view of the backpack component of the backpack carrier similar to FIG. 4, depicting yet another internal storage area defined by the backpack component.

As seen in FIGS. 1-3 and 6 and viewed from the perspective provided thereby, protruding from approximately the center of the seam or junction between the top peripheral edge segments of the front panel 16 and a corresponding one of the side panels 18 which spans the top of the backpack component 12 is a loop handle 72. In a preferred implementation, the loop handle 72 is fabricated from webbing and is rigidly secured to the remainder of the backpack component 12 using, for example, stitching. Similarly, as shown in FIGS. 4 and 5, protruding from approximately one of the two upper corner regions of the seam or junction between the front panel 16 and a corresponding one of the side panels 18 which spans the top of the backpack component 12 is a stroller strap 74. Integrated into the stroller strap 74 is a buckle 76 which includes complementary male and female connectors. The selective detachment of the connectors from each other allows the stroller strap 74 to be extended or looped about, for example, a stroller handle, with the subsequent re-engagement of the connectors to each other thus allowing the backpack carrier 10 to be maintained in a suspended state from such handle.

As further seen in FIGS. 4-5, the exemplary implementation of the backpack component 12 further defines a series vertically oriented or extending pouches which are defined by the front panel 16 in combination with one or more interior panels, such as the interior panel 77 shown in FIGS. 4-5. In greater detail, these vertically extending pouches include a first front pouch 78 which extends vertically along almost the entire length of one of the opposed sides of the backpack component 12. As seen in FIG. 5, the opening of the first front pouch 78, which is selectively closable using an associated zipper 80, is collectively defined by corresponding peripheral edge segments of the front panel 16 and at least one of the side panels 18. In addition to the first front pouch 78, the vertically extending pouches include a second front pouch 82 and a third front pouch 84 which extend vertically in end-to-end fashion along almost the entire length of the remaining one of the opposed sides of the backpack component 12. As seen in FIG. 4, the opening of the second front pouch 82, which is selectively closable using an associated zipper 86, is collectively defined by corresponding peripheral edge segments of the front panel 16 and at least one of the side panels 18. Similarly, the opening of the third front pouch 84, which is selectively closable using an associated zipper 88, is likewise collectively defined by corresponding peripheral edge segments of the front panel 16 and at least one of the side panels 18. The third front pouch 84 is particularly suited for cell phone storage, though it can be used to store other items as well. The first front pouch 78 is itself particularly suited for the storage of a selectively deployable changing mat.

Figure 6:
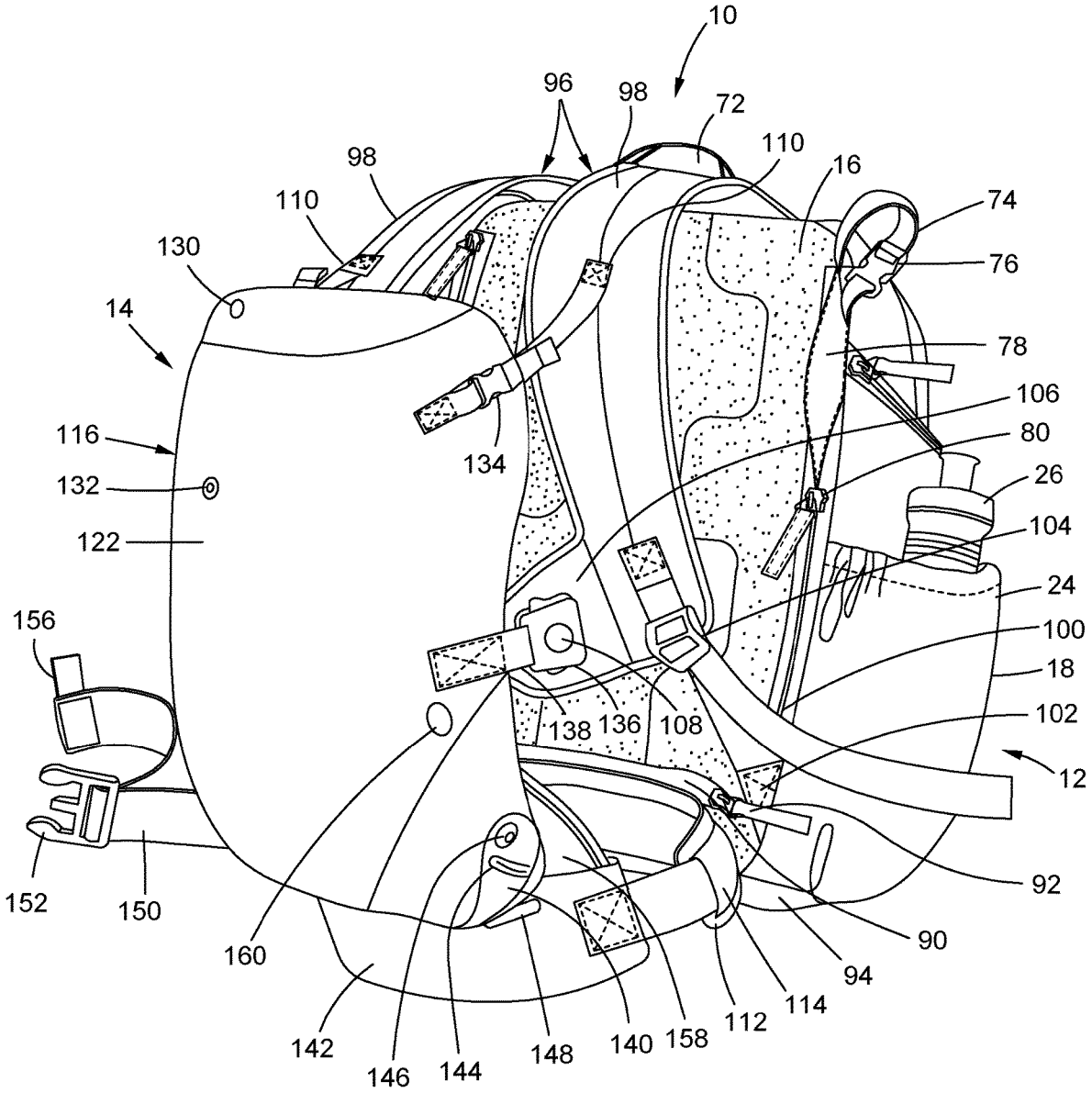
FIG. 6 is a front perspective view of the backpack carrier constructed in accordance with the present disclosure, depicting the backpack component as having the soft infant carrier component cooperatively engaged thereto in a deployed state.

Referring now to FIGS. 4-6, in addition those pockets/pouches described above, the backpack component 12 defines yet another storage compartment, and more particularly a carrier storage compartment 90. Importantly, the carrier storage compartment 90 is a false bottom to the backpack carrier component 12, separated or isolated from any other interior or exterior storage portions of the backpack carrier component 12, including any other pockets or pouches thereof. In this way, other items that may be stored in any other part of the backpack component 12 are prevented from falling into the carrier storage compartment 90 and potentially getting lost therein. The interior of the carrier storage compartment 90 is selectively accessed via an elongate opening which extends across the front panel 16 between an opposed pair of side panels 18, such opening being selectively openable and closable using a corresponding zipper 92. Along these lines, the carrier storage compartment 90 is also partially defined by at least one bottom panel 94 of the carrier component 12 which extends between and interconnects a corresponding pair of side panels 18 thereof. As will be described in more detail below, the carrier storage compartment 90 is primarily adapted to accommodate the carrier component 14 of the backpack carrier 10, the carrier component being removably stored within the carrier storage compartment 90.

It is contemplated that those structural features of the backpack component 12 described above, and notably the various front, side, back and bottom panels 16, 18, 32, 94, as well as any interior panels including the interior panels 37, 66, 77, will typically be fabricated from a suitable fabric material, and secured to each other via stitching. However, those of ordinary skill in the art will recognize that the present invention is not intended to be limited to any particular material(s) for the aforementioned structural features of the backpack component 12, or any particular modality for securing those structural features to each other. Along these lines, those of ordinary skill in the art will further recognize that the particular, number, size, arrangement, etc. of pockets, pouches, and sleeves as described above is also exemplary only and may be varied in many ways without departing from the spirit and scope of the present disclosure.

Referring now to FIGS. 1 and 6, the backpack component 12 of the backpack carrier 10 further comprises an identically configured pair of shoulder straps 96 which are adapted to be extensible over respective ones of the wearer's shoulders. Each of the shoulder straps 96 preferably has a two-piece construction. In greater detail, each of the shoulder straps 96 comprises a primary segment 98 which is of a relatively wide and relatively thick padded construction, preferably fabricated from two opposed layers of a soft yet durable fabric material having a padded layer therebetween, the peripheral edges of the fabric layers being secured to each other using stitching. As is most apparent from FIG. 6, one end portion of the primary segment 98 of each shoulder strap 96 is secured within and protrudes from approximately the seam or junction between the top peripheral edge segments of the front panel 16 and a corresponding one of the side panels 18 which spans the top of the backpack component 12.

In addition to the primary segment 98, each shoulder strap 96 includes a secondary segment 100 which is of a narrower and thinner construction (e.g., webbing) in comparison to the corresponding primary segment 98. Within each shoulder strap 96, the secondary segment 100 is cooperatively engaged to that end portion of the corresponding primary segment 98 opposite the end portion attached to the top peripheral edge segments of the front and side panels 16, 18. As seen in FIGS. 1 and 6, one end portion of the secondary segment 100 is operatively coupled to a gusset 102 protruding from approximately the lower portion of the seam or junction between the side peripheral edge segments of the front panel 16 and a corresponding one of the side panels 18. The cooperative engagement of the secondary segment 100 to the corresponding primary segment 98 is facilitated by a strap adjuster 104 secured to the primary segment 98 as allows for adjustments to the effective length of the secondary segment 100, and hence the corresponding shoulder strap 96.

As most clearly shown in FIG. 6, the primary segment 98 of each shoulder strap 96 defines a gusset portion 106 which, from the perspective of FIG. 6, protrudes inwardly from the distal portion thereof. Disposed on the outer surface of each gusset portion 106 is a corresponding one of an identically configured pair of connector posts 108 of the backpack component 12. The use of the connector posts 108 will be described in more detail below. In addition, attached to the outer surface of the primary segment 98 of each shoulder strap 96 in relative close proximity to the top end thereof is a corresponding one of an identically configured pair of head support straps 110 of the backpack component 12. The use of the head support straps 110 will also be described in more detail below. The head support straps 110 are secured using, for example, stitching, to corresponding primary segments 98 of the shoulder straps 96.

Figure 9:
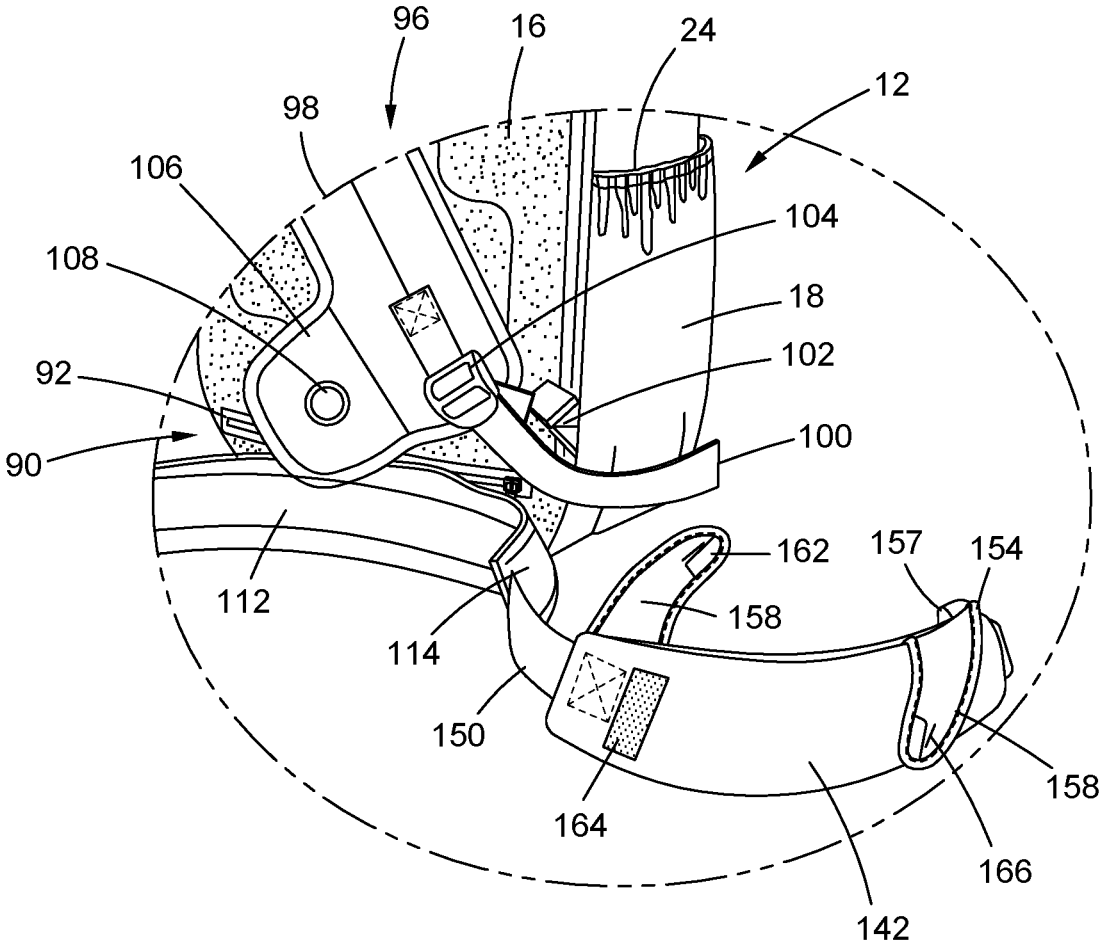
FIG. 9 depicts only the lumbar belt front of the carrier component and its manner of cooperative engagement to the lumbar belt back of the backpack component.

Referring now to FIGS. 6 and 9, the backpack component 12 further comprises a lumber belt back 112 which is permanently attached thereto and is normally stored within the carrier storage compartment 90 used to accommodate the stored carrier component 14. The lumbar belt back 112 defines an elongate sleeve 114 on one side or face thereof, the sleeve 114 including opposed open ends. In greater detail, it is contemplated that one longitudinally extending peripheral edge segment of the generally rectangular lumbar belt back 112 will be secured along its length to an interior surface of the carrier storage compartment 90 using, for example, stitching. With the carrier storage compartment 90 being opened using the zipper 92, the lumbar belt back 112 may be folded outwardly as facilities its removal from therein in the manner shown in FIG. 6. When so removed and allowed to hang from the remainder of the backpack component 12 in the contemplated manner, the sleeve 114 of the lumbar belt back faces the front panel 16. The use of the lumbar belt back 112 and its associated sleeve 114 will also be described in more detail below.

Having thus described the structural features of the backpack component 12 of the backpack carrier 10, attention will now be turned to the carrier component 14 with specific reference to FIGS. 6-9. The carrier component 14 comprises a carrier panel or body 116 defining an exteriorly presented outer surface, and an opposed, interiorly presented inner surface. When viewed from the perspective shown in FIGS. 1 and 7, the carrier body 116 further defines a head portion 118, a seat portion 120, and a central portion 122 which extends between the head and seat portions 118, 120. Approximately the lower third of the carrier body 116 defines the seat portion 120 thereof, the use of which will be described in more detail below. The head portion 118 defines an arcuately contoured, generally convex top edge segment 124. The opposed ends of this top edge segment 124 transition into each of an opposed pair of generally linear side edge segments 126 of the carrier body 116. A bottom edge segment 128 of the carrier body 116 is defined by the seat portion 120 thereof, with the side edge segments 126 extending between the top and bottom edge segments 124, 128.

Disposed on the outer surface of the carrier body 116 on the head portion 118 thereof and proximate to the top edge segment 124 is a connector 130 (e.g., a male snap). In addition, disposed on the outer surface of the carrier body 116 on the central portion 122 thereof is complimentary connector 132 (e.g., a female snap) which is vertically aligned with the connector 130. The connector 130 is adapted to be releasably engageable to the connector 132. In the carrier component 14, the head portion 118 is adapted to be selectively folded to transition from an extended state (shown in FIG. 6) to a folded state. The head portion 118 is maintainable in its folded state by the releasable engagement of the connector 130 to the connector 132. When the head portion 118 is in its folded state, at least a portion of the outer surface of the carrier body 116 as defined by the head portion 118 is directed toward or faces a portion of the outer surface of the carrier body 116 as defined by the central portion 122, with a portion of the inner surface of the carrier body 116 thus being outwardly or exteriorly presented. As will be recognized by those of ordinary skill in the art, the positioning of the head portion 118 of the carrier body panel 116 in its extended state provides a greater measure of support to the head of an infant carried within the carrier component 14.

Figure 7:
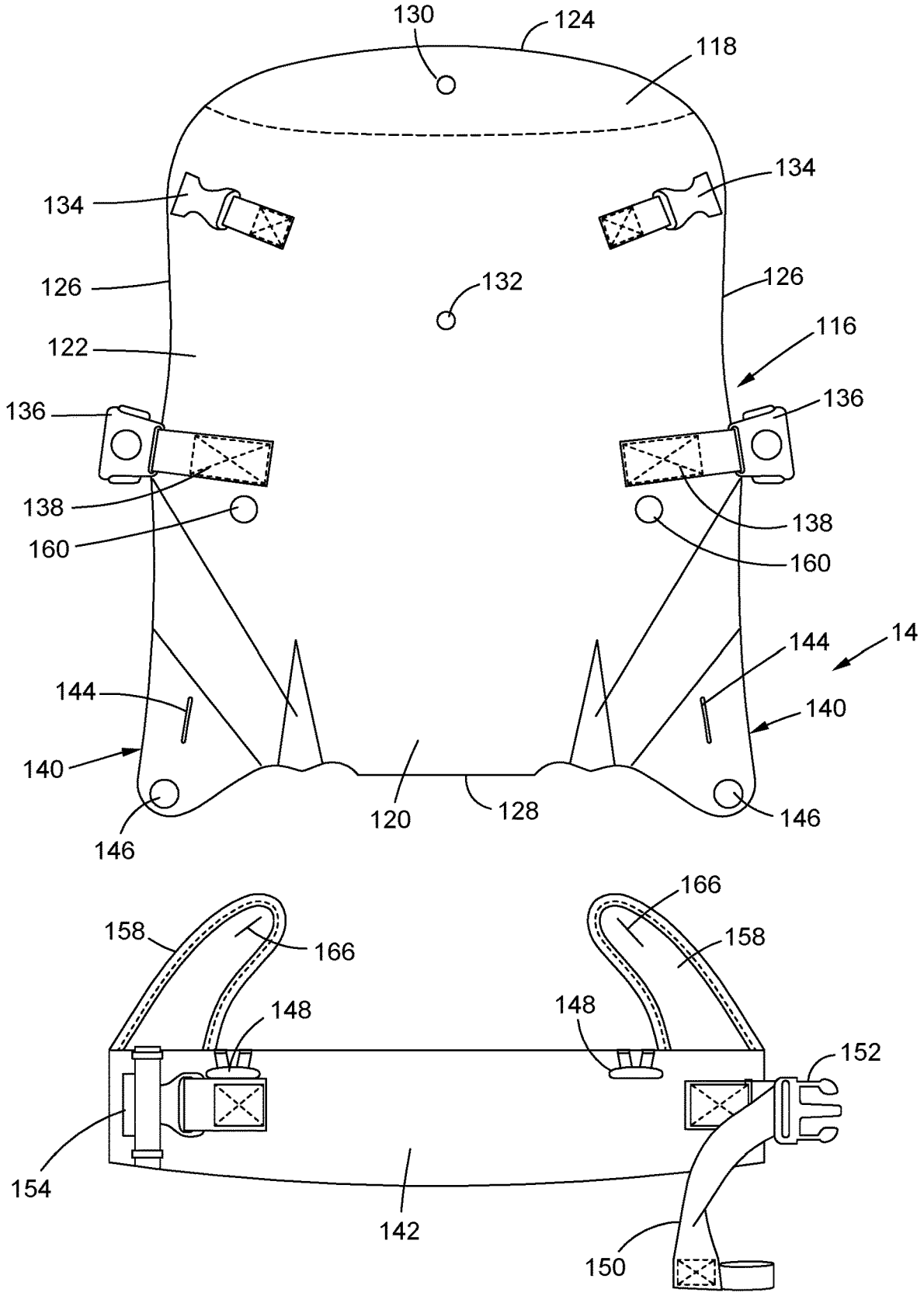
FIG. 7 is an exploded view of the carrier component, depicting the exterior surfaces of the carrier body and lumbar belt front thereof.

As seen in FIGS. 6-7, the carrier component 14 further comprises an identically configured pair of head support connectors 134 which are secured to the outer surface of the carrier body 116 at approximately the junction between the head and central portions 118, 122, and in relative close proximity to respective ones of the side edge segments 126. The head support connectors 134 (e.g., female buckles) are adapted to be releasably engageable to complementary connectors (e.g., male buckles) disposed on the distal ends of respective ones of the head support straps 110 as will be discussed in more detail below.

The carrier component 14 also includes an identically configured pair of spring latches 136. The spring latches 136 are secured to the distal ends of respective ones of a pair of latch straps 138. These latch straps 138 are in turn secured to the outer surface of the carrier body 116 at central portion 122, and in relative close proximity to respective ones of the side edge segments 126. In this regard, the latch straps 138 are sized and oriented such that the spring latches 136 secured thereto may each be positionable slightly beyond a respective one of the side edge segments 126 in the manner shown in FIG. 6. The spring latches 136 are adapted to be releasably engageable to respective ones of the connector posts 108 as will also be discussed in more detail below.

The carrier component 14 further comprises a pair of generally triangular conversion flaps 140 which protrude from the seat portion 120 in opposed relation to each other. The conversion flaps 140 are selectively transitional between a stowed or narrow configuration, wherein free end portions of the conversion flaps 140 are releasably attached to each other, and a deployed or wide configuration wherein the free end portions of the conversion flaps 140 are releasably attached to a lumbar belt front 142 of the carrier component 14. In greater detail, with references to FIGS. 6-7, and based on the perspectives shown therein, a central portion of the top edge of the lumbar belt front 142 is rigidly secured to the bottom edge segment 128 of the carrier body 116 which extends between the conversion flaps 140. Such attachment is facilitated along a somewhat narrow seam using, for example, stitching, such that the lumbar belt front 142 is easily movable or foldable relative to the carrier body 116 along such seam.

Each of the conversion flaps 140 includes an elongate slot 144 and an adjacent fastener 146 (e.g., a conversion snap) disposed at the free end portion thereof which is defined approximately at the apex between those two side edge segments not secured to the carrier body 14. Each slot 144 is adapted to accommodate a respective one of a pair of fasteners 148 (e.g., toggles) which are each attached to the lumbar belt front 142 in spaced relation to each other at or proximate to the top edge thereof. The receipt of the fasteners 148 into corresponding ones of the slots 144 effectively maintains the conversion flaps 140 in the wide configuration. Conversely, the removal of the fasteners 148 from within the slots 144 allows the conversion flaps 140 to be folded inwardly toward each other in overlapping relation to the outer surface of the carrier body 14 at approximately the central portion 122 thereof. In this folded state, the adjustment fasteners 146 (one male, one female) of the conversion flaps 140 may be releasably attached to each other as effectively maintains the conversion flaps 140 in the narrow configuration.

Figure 8:
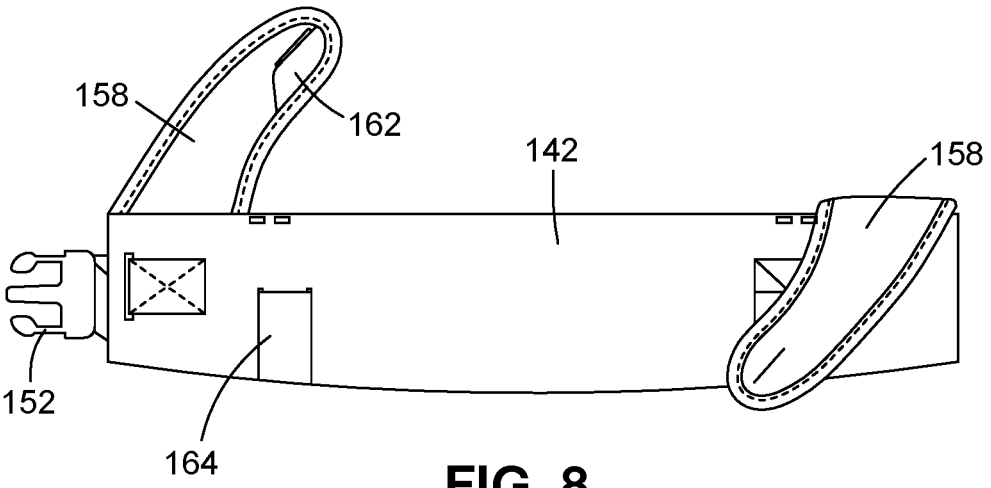
FIG. 8 depicts the opposed, interior surface of the lumbar belt front shown in FIG. 7.

FIG. 7 depicts an exterior surface of the lumbar belt front 142, with FIG. 8 depicting the opposed interior surface thereof. As shown therein, the lumbar belt front 142 further includes an elongate lumbar belt strap 150 which may be fabricated from a webbing material. As seen in FIG. 7, one end of the lumbar belt strap 150 is rigidly secured to the exterior surface of the lumbar belt front 142 proximate one of the opposed, laterally extending sides thereof. Attached to and adjustably positionable along the length of the lumbar belt strap 150 is a connector 152 (e.g., a male buckle) which is releasably attachable to complementary connector 154 (e.g., a female buckle) rigidly secured to the exterior surface of the lumbar belt front 142 proximate the remaining one of the opposed, laterally extending sides thereof. The releasable attachment of the connectors 152, 154 to each other maintains the lumbar belt strap 150 in a closed-loop arrangement or configuration, the girth of which may be selectively adjusted by moving the connector 152 along the lumbar belt strap 150. As seen in FIG. 6, the lumbar bet strap 150 may be outfitted with a storage loop 156 adapted to accommodate a portion of any used length thereof for compact, efficient storage. In addition, the lumbar belt front 142 may be outfitted with an elastic retention band which extends between the top and bottom edges thereof and engages the connector 154 in a manner preventing the sliding thereof.

The lumbar belt front 142 further comprises a pair of elongate leg loops 158 which are attached thereto so as to be selectively extensible from the top edge thereof in spaced relation to each other, proximate respective ones of the opposed, laterally extending sides of the lumbar belt front 142. The leg loops 158 are selectively, releasably attachable to respective ones of a corresponding pair of fasteners 160 (e.g., buttons) disposed on the outer surface of the carrier body 116. In greater detail, the fasteners 160 are located on the outer surface of the central portion 122 of the carrier body 116 in horizontally aligned, spaced relation to each other.

Each of the leg loops 158 is selectively movable between a stored state and a deployed state, both of which are shown in FIG. 8, the deployed state also being shown in FIG. 7. Each of the leg loops 158 is maintainable in its stored state by the releasable engagement of a swatch 162 of hook and loop fastener disposed on the interior surface thereof proximate its distal end to a corresponding one of a complementary pair of swatches 164 of hook and loop fastener material disposed on the interior surface of the lumbar belt front 142. When the leg loops 158 are in their deployed state, the releasable engagement thereof to respective ones of the fasteners 160 (as discussed in more detail below) is facilitated by the advancement of each such fastener 160 through of complementary slit (e.g., button hole) 166 formed in each leg loop 158 proximate the distal end thereof.

As indicated above, the carrier component 14 is normally hidden inside the carrier storage compartment 90 of the backpack component 12. When use of the backpack carrier 10 to carry an infant is desired by the wearer, he or she can unzip the carrier storage compartment 90 using the associated zipper 92 and pull out the carrier component 14 from therein. At the same time, the wearer will pull the lumbar belt back 112 from its stored state within the carrier storage compartment 90 by folding it outwardly therefrom in the above-described manner.

With the carrier component 14 being removed from within the carrier storage compartment 90 along with the lumbar belt back 112, the lumbar belt strap 150 may be advanced through the sleeve 114 of the lumbar belt back 112. The lumbar belt strap 150 can then be encircled about the wearer's waist and maintained thereon by coupling the connector 152 to the connector 154. When such coupling occurs, it is contemplated that the front panel 16 of the backpack component will rest upon the wearer's back, the lumbar belt back 112 will rest upon and extend along a portion of the wearer's lower back, and the lumbar belt front 142 will rest upon and extend along a portion of the wearer's lower abdomen. Thus, the lumbar belt back 112, the lumbar belt front 142 and the lumber belt strap 150 (with the connectors 152, 154 being coupled to each other) collectively define a lumbar belt or waist belt of the backpack carrier 10 with the carrier component 14 thereof being in its deployed state.

With this collectively defined lumbar belt being secured about the wearer's waist, the carrier body 116 of the carrier component 14 is then secured to the backpack component 12 by hooking up to the various attachment points thereof as described above. In greater detail, the spring latches 136 are first releasably engaged to respective ones of the connector posts 108. Though not shown with particularity, each of the spring latches 136 comprises a housing having a single, unitary lock member operatively engaged thereto. The lock member is interfaced to the housing in a manner wherein an opposed pair of finger press key portions defined by the lock member protrude from respective opposed sides of the housing. The simultaneous pressing of the opposed finger press key portions inwardly toward each other facilitates the concurrent movement of an opposed pair of arcuate engagement portions also defined by the lock member away from each other, thus allowing a corresponding connector post 108 to be advanced into a complementary, circularly configured opening defined solely by the housing. Conversely, releasing the press key portions causes the engagement portions to resiliently spring or return to their original position as facilitates their cooperative engagement to the connector post 108 when such post 108 is advanced through the central opening of the housing. In this regard, the lock member also includes a pair of resilient spring portions, each of which is integrally connected to and extends between the key portions and includes one of the engagement portions integrally connected thereto. As will be recognized, in uncoupling each spring latch 136 from its corresponding connector post 108, pressing the finger press key portions toward each other allows the connector post 108 to be removed from within the complementary opening defined by the housing of the spring latch.

With the spring latches 136 being coupled to the connector posts 108, the connectors secured to the distal ends of the head support straps 110 are then releasably coupled to respective ones of the head support connectors 134. With such attachment, the carrier body 16 and wearer's chest collectively define a child carrying area of the backpack carrier 10. It is contemplated that an infant or small child will be positioned in this carrying area, facing inwardly toward the wearer or outwardly away from the wearer, prior to the coupling of the spring latches 136 to the connector posts 108 and the head support straps 110 to the head support connectors 134. In either of the front or rear carry configurations, it is contemplated that seat portion 120 of the carrier body 116 will at least partially overhang or be draped over the lumbar belt front 142, with the weight of the infant being transferred not only into the lumbar belt strap 150 and lumbar belt back 112 for distribution into the wearer's hips and back, but also into the shoulder straps 96 for distribution into each of the wearer's shoulders. In either of these carrying configurations, the effective width of the seat portion 120 can be selectively increased or decreased by the manipulation of the conversion flaps 140 into either of the aforementioned narrow or wide configurations.

Also, within this carrying area, each of the infant's legs will protrude from a corresponding leg opening collectively defined by the wearer's chest, the seat portion 120 of the carrier body 16, portions of the lumbar back, front and belt strap 112, 142, 150, and a corresponding one of the outwardly flared gusset portions 106 having the associated spring latch operatively coupled thereto. However, in the event these leg openings are too large for a small infant, the leg loops 158 are provided to facilitate the creation of smaller leg openings. In this regard, when attached to the fasteners 160 in the aforementioned manner, the leg loops 158 facilitate the formation of a spaced, comparatively smaller pair of leg openings, each of which is collectively defined by one of the leg loops 158, a portion of the lumbar belt front 142, and the seat portion 120 of the carrier body 116. The leg loops 158 may be deployed to facilitate the formation of these smaller leg openings when the conversion flaps 140 are in the narrow or wide configurations to provide a safeguard for a smaller infant being carried within the backpack carrier 10, assisting in preventing the infant from being able to slip out from between the wearer and the carrier body 116.

Still further, the head portion 118 of the carrier body 116 may be selectively manipulated between its extended and folded states in the aforementioned manner as may be needed to properly support the head of the infant within the backpack carrier 10. Because they are outfitted with the length adjusting modalities described above, the effective lengths of both the shoulder straps 96 and the lumbar belt strap 150 may be selectively increased or decreased as needed to achieve a proper fit to the wearer based not only on the wearer's physical attributes, but those of the infant to be carried as well. In this regard, as will be recognized, the adaptability of the carrier component 14 of the backpack carrier 10 to the infant's physical features is further enhanced by the width adjustability of the seat portion 120, as well as the optional deployment of the leg loops 158 and the folding/unfolding of the head portion 118 of the carrier body 116.

In the carrier component 14, the carrier body 116 is preferably fabricated from two opposed layers of a soft yet durable fabric material, the peripheral edges of which are secured to each other through the use of stitching. Additionally, a padded layer is interposed between prescribed areas of these fabric layers. Additionally, those of ordinary skill in the art that attachment modalities other than for snaps, buckles, toggles, slots, zippers, buttons and button holes may be substituted for the various fasteners/attachment modalities described above without departing from the spirit and scope of the present disclosure.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A backpack carrier wearable by a user and suitable for use as a backpack and for optionally carrying an infant, the backpack carrier comprising:

a backpack component comprising:

a pair of shoulder straps extensible over the shoulders of the wearer;

a plurality of storage areas;

a prescribed carrier storage compartment; and a lumbar belt back which normally resides within the carrier storage compartment and is secured therein in a manner as allows the lumbar belt back to be selectively extensible therefrom, the lumbar belt back defining a sleeve;

a carrier component stored within the carrier storage compartment and selectively removable therefrom, the carrier component comprising:

carrier body at least partially defining a seat portion and outfitted with attachment modalities operative to facilitate the releasable attachment thereof to prescribed, corresponding attachment points on the shoulder straps;

a pair of conversion flaps attached to and protruding from the carrier body in opposed relation to each other;

a lumbar belt front attached to the carrier body; and a lumbar belt strap attached to the lumbar belt front and extensible through the sleeve of the lumbar belt back;

the conversion flaps being selectively positionable in a narrow configuration wherein they are releasably attached to each other in overlapping relation to a portion of the carrier body, and a wide configuration wherein they are releasably attached to prescribed portions of the lumbar belt front.

2. The backpack carrier of claim 1, further comprising:

a pair of leg loops attached to and protruding from the lumbar belt front in spaced relation to each other;

each of the leg loops being selectively, releasably attachable to the carrier body to facilitate the formation of a spaced pair of leg openings between the leg loops and the lumbar belt front.

3. The backpack carrier of claim 1, wherein the carrier body defines a head portion which is foldable relative to the remainder thereof from an extended state to a folded state, the head portion at least partially overlapping the remainder of the carrier body panel when in the folded state.

4. The backpack carrier of claim 1, wherein:

each of the conversion flaps has a generally triangular configuration including an apex collectively defined by a pair of side edge segments thereof which are not secured to the carrier body; and each of the conversion flaps includes a slot formed therein and a fastener disposed thereon, the slot and the fastener between disposed proximate to each other and to the apex.

5. The backpack carrier of claim 4, wherein the lumber belt front includes a pair of toggles attached thereto in spaced relation to each other, the toggles being selectively advanceable through respective ones of the slots to maintain the conversion flaps in the wide configuration.

6. The backpack carrier of claim 1, wherein the attachment modalities used to facilitate the releasable attachment of the carrier body to the shoulder straps comprise:

a pair of head support connectors attached to the carrier body in spaced relation to each other, the head support connectors being releasably attachable to respective ones of a corresponding pair of head support straps attached to and extending from respective ones of the shoulder straps; and a pair of latch straps attached to and extending from the carrier body in spaced relation to each other, the latch straps being releasably attachable to respective ones of a corresponding pair of connector posts attached to respective ones of the shoulder straps.

7. The backpack carrier of claim 6, wherein each of the latch strips is outfitted with a spring latch adapted to be releasably engageable to a respective one of the connector posts.

8. The backpack carrier of claim 6 wherein each of the shoulder straps includes an outwardly flared gusset portion, and each of the connector posts is disposed on a respective one of the gusset portions.

9. A backpack carrier wearable by a user and suitable for use as a backpack and for optionally carrying an infant, the backpack carrier comprising:

a backpack component comprising:

a pair of shoulder straps extensible over the shoulders of the wearer;

a carrier storage compartment; and a lumbar belt back which normally resides within the carrier storage compartment and is secured therein in a manner as allows the lumbar belt back to be selectively extensible therefrom, the lumbar belt back defining a sleeve;

a carrier component stored within the carrier storage compartment and selectively removable therefrom, the carrier component comprising:

a carrier body outfitted with attachment modalities operative to facilitate the releasable attachment thereof to prescribed, corresponding attachment points on the shoulder straps;

a lumbar belt front attached to the carrier body; and a lumbar belt strap attached to the lumbar belt front and extensible through the sleeve of the lumbar belt back;

wherein the attachment modalities comprise:

a pair of head support connectors attached to the carrier body in spaced relation to each other, the head support connectors being releasably attachable to respective ones of a corresponding pair of head support straps attached to and extending from respective ones of the shoulder straps; and a pair of latch straps attached to and extending from the carrier body in spaced relation to each other, the latch straps being releasably attachable to respective ones of a corresponding pair of connector posts attached to respective ones of the shoulder straps.

10. The backpack carrier of claim 9 wherein the carrier component further comprises a pair of conversion flaps attached to and protruding from the carrier body in opposed relation to each other, the conversion flaps being selectively positionable in a narrow configuration wherein they are releasably attached to each other in overlapping relation to a portion of the carrier body, and a wide configuration wherein they are releasably attached to prescribed portions of the lumbar belt front.

11. The backpack carrier of claim 10, wherein:

each of the conversion flaps has a generally triangular configuration including an apex collectively defined by a pair of side edge segments thereof which are not secured to the carrier body; and each of the conversion flaps includes a slot formed therein and a fastener disposed thereon, the slot and the fastener between disposed proximate to each other and to the apex.

12. The backpack carrier of claim 11, wherein the lumber belt front includes a pair of toggles attached thereto in spaced relation to each other, the toggles being selectively advanceable through respective ones of the slots to maintain the conversion flaps in the wide configuration.

13. The backpack carrier of claim 9, further comprising:

a pair of leg loops attached to and protruding from the lumbar belt front in spaced relation to each other;

each of the leg loops being selectively, releasably attachable to the carrier body to facilitate the formation of a spaced pair of leg openings between the leg loops and the lumbar belt front.

14. The backpack carrier of claim 9, wherein the carrier body defines a head portion which is foldable relative to the remainder thereof from an extended state to a folded state, the head portion at least partially overlapping the remainder of the carrier body panel when in the folded state.

15. The backpack carrier of claim 9, wherein each of the latch strips is outfitted with a spring latch adapted to be releasably engageable to a respective one of the connector posts.

16. The backpack carrier of claim 9, wherein each of the shoulder straps includes an outwardly flared gusset portion, and each of the connector posts is disposed on a respective one of the gusset portions.

17. A backpack carrier wearable by a user and suitable for use as a backpack and for optionally carrying an infant, the backpack carrier comprising:

a backpack component comprising:

a pair of shoulder straps extensible over the shoulders of the wearer; and a lumbar belt back which is secured to and at least partially resides within the backpack component, the lumbar belt back being selectively extensible from the backpack component;

a carrier component at least partially stored within the backpack compartment and selectively deployable therefrom, the carrier component comprising:

carrier body outfitted with attachment modalities operative to facilitate the releasable attachment thereof to prescribed, corresponding attachment points on the backpack component;

a lumbar belt front attached to the carrier body;

a lumbar belt strap attached to the lumbar belt front and cooperatively engageable to the lumbar belt back; and a pair of conversion flaps attached to and protruding from the carrier body in opposed relation to each other, the conversion flaps being selectively positionable in a narrow configuration wherein they are releasably attached to each other in overlapping relation to a portion of the carrier body, and a wide configuration wherein they are releasably attached to prescribed portions of the lumbar belt front.

18. The backpack carrier of claim 17, wherein the attachment modalities used to facilitate the releasable attachment of the carrier body to the backpack component comprise:

a pair of head support connectors attached to the carrier body in spaced relation to each other, the head support connectors being releasably attachable to respective ones of a corresponding pair of head support straps attached to and extending from respective ones of the shoulder straps; and a pair of latch straps attached to and extending from the carrier body in spaced relation to each other, the latch straps being releasably attachable to respective ones of a corresponding pair of connector posts attached to respective ones of the shoulder straps.

* * * * *